US008418989B2

(12) United States Patent
Burkhard et al.

(10) Patent No.: US 8,418,989 B2
(45) **Date of Patent: *Apr. 16, 2013**

(54) PRESSURE-BALANCED CHOKE SYSTEM

(75) Inventors: Alan Wayne Burkhard, Fort Thomas, KY (US); Nicolas Christopher Wade Thiessen, Edmonton (CA)

(73) Assignee: M-I L.L.C., Houston, TX (US)

( * ) Notice: Subject to any disclaimer, the term of this patent is extended or adjusted under 35 U.S.C. 154(b) by 838 days.

This patent is subject to a terminal disclaimer.

(21) Appl. No.: 11/959,371

(22) Filed: Dec. 18, 2007

(65) Prior Publication Data

US 2008/0149200 A1 Jun. 26, 2008

Related U.S. Application Data

(60) Provisional application No. 60/871,225, filed on Dec. 21, 2006.

(51) Int. Cl.
*F16K 31/02* (2006.01)

(52) U.S. Cl.
USPC ..... 251/14; 251/129.03; 137/495; 137/509

(58) Field of Classification Search ..... 251/61, 251/62, 63.5, 63.6, 118, 122, 14, 129.03; 137/495, 509
See application file for complete search history.

(56) References Cited

U.S. PATENT DOCUMENTS 3,298,389 A * 1/1967 Freeman ..... 137/454.6
3,840,049 A * 10/1974 Field, Jr. ..... 137/625.63
3,860,840 A * 1/1975 Laronze ..... 310/13
4,211,147 A * 7/1980 Panissidi et al. ..... 91/184
4,296,912 A * 10/1981 Ruyak ..... 251/65
4,355,784 A 10/1982 Cain
4,413,646 A * 11/1983 Platt et al. ..... 137/240
4,461,450 A * 7/1984 Soland et al. ..... 251/63.5
4,474,356 A * 10/1984 Baumann ..... 251/122
4,533,113 A * 8/1985 Francart, Jr. ..... 251/63.4
4,535,809 A * 8/1985 Andersson ..... 137/596.14
4,563,939 A * 1/1986 Siegrist ..... 91/275
4,607,822 A * 8/1986 Schabert et al. ..... 251/334
4,617,992 A * 10/1986 Abel ..... 251/14
5,386,965 A 2/1995 Marchal (Continued)

OTHER PUBLICATIONS

PCT International Search Report issued in PCT Application No. PCT/US2007/088400 dated Jun. 2, 2008 (3 pages).

(Continued)

*Primary Examiner* — Eric Keasel
(74) *Attorney, Agent, or Firm* — Osha Liang LLP

(57) ABSTRACT

Disclosed are a fluid control system and method of controlling operating pressures within a fluid system, where the fluid control system includes a choke assembly, a pressure generating device, and a linear motor. The choke assembly may include a housing and a choke member adapted for movement in the housing, controlling the flow of a fluid from an inlet passage to an outlet passage. The fluid applies a force on a first end of the choke member. The pressure generating device may be fluidly connected to a chamber and may contain a control fluid that applies a first force on a second end of the choke member. The linear motor may apply a second force on the second end of the choke member. The difference between the forces applied to the first and second ends of the choke member may affect the movement of the choke member in the housing.

19 Claims, 4 Drawing Sheets

U.S. PATENT DOCUMENTS

| | | | | |
|---|---|---|---|---|
| 5,984,261 | A * | 11/1999 | Akita | 251/127 |
| 6,253,787 | B1 | 7/2001 | Suter et al. | |
| 6,575,244 | B2 | 6/2003 | Chang et al. | |
| 7,004,448 | B2 | 2/2006 | Suter et al. | |
| 7,044,434 | B2 * | 5/2006 | Brinks et al. | 251/122 |
| 7,287,739 | B2 * | 10/2007 | Arnison et al. | 251/14 |
| 7,699,071 | B2 * | 4/2010 | Burkhard et al. | 137/495 |
| 2005/0006150 | A1 | 1/2005 | Sims et al. | |

OTHER PUBLICATIONS

PCT Written Opinion issued in PCT Application No. PCT/US2007/088400 dated Jun. 2, 2008 (4 pages).

Examination Report issued in corresponding British Patent Application No. GB0910561.0; Dated Oct. 29, 2010 (2 pages).

Examination Report issued in corresponding British Patent Application No. GB0910561.0; Dated Mar. 1, 2011 (3 pages).

Examiner's Report issued in corresponding Canadian Patent Application No. 2,673,055; Dated Mar. 25, 2011 (2 pages).

Examination Report issued in corresponding British Application No. GB0910561.0; Dated Aug. 25, 2011 (2 pages).

Examiner's Report issued in corresponding Canadian Application No. 2,673,055; Dated Mar. 7, 2012 (2 pages).

* cited by examiner

PRESSURE-BALANCED CHOKE SYSTEM

CROSS-REFERENCE TO RELATED APPLICATIONS

This application, pursuant to 35 U.S.C. §119(e), claims priority to U.S. Provisional Application Ser. No. 60/871,225, filed on Dec. 21, 2006. That application is incorporated by reference in its entirety.

BACKGROUND OF INVENTION

1. Field of the Invention

Embodiments disclosed herein relate generally to subterranean boreholes, and in particular, to systems for controlling the operating pressures within subterranean boreholes.

2. Background

There are many applications in which there is a need to control the back pressure of a fluid flowing in a system. For example, in the drilling of oil wells it is customary to suspend a drill pipe in the wellbore with a bit on the lower end thereof and, as the bit is rotated, to circulate a drilling fluid, such as a drilling mud, down through the interior of the drill string, out through the bit, and up the annulus of the wellbore to the surface. This fluid circulation is maintained for the purpose of removing cuttings from the wellbore, for cooling the bit, and for maintaining hydrostatic pressure in the wellbore to control formation gases, prevent blowouts, and the like. In those cases where the weight of the drilling mud is not sufficient to contain the bottom hole pressure in the well, it becomes necessary to apply additional back pressure on the drilling mud at the surface to compensate for the lack of hydrostatic head and thereby keep the well under control. Thus, in some instances, a back pressure control device is mounted in the return flow line for the drilling fluid.

Back pressure control devices are also necessary for controlling "kicks" in the system caused by the intrusion of salt water or formation gases into the drilling fluid which may lead to a blowout condition. In these situations, sufficient additional back pressure must be imposed on the drilling fluid such that the formation fluid is contained and the well controlled until heavier fluid or mud can be circulated down the drill string and up the annulus to regain well pressure control. It is also desirable to avoid the creation of excessive back pressures which could cause the drill string to stick or cause damage to the formation, the well casing, or the well head equipment.

Referring to FIG. 1, a typical oil or gas well 10 may include a wellbore 12 that has a wellbore casing 16. During operation of the well 10, a drill pipe 18 may be positioned within the wellbore 12. As will be recognized by persons having ordinary skill in the art, the end of the drill pipe 18 may include a drill bit (not shown) and drilling mud may be injected through drill pipe 18 to cool the drill bit and to remove particles drilled by the drill bit. A mud tank 20 containing a supply of drilling mud may be operably coupled to a mud pump 22 for injecting the drilling mud into the drill pipe 18. The annulus 24 between the wellbore casing 16 and the drill pipe 18 may be sealed in a conventional manner using, for example, a rotary seal 26.

To control the operating pressures within the well 10 within acceptable ranges, a choke 28 may be operably coupled to the annulus 24 in order to controllably bleed pressurized fluidic materials out of the annulus 24 back into the mud tank 20 to thereby create back pressure within the wellbore 12.

The choke 28, in some well systems, may be manually controlled by a human operator 30 to maintain one or more of the following operating pressures within the well 10 within acceptable ranges: (1) the operating pressure within the annulus 24 between the wellbore casing 16 and the drill pipe 18, commonly referred to as the casing pressure (CSP); (2) the operating pressure within the drill pipe 18, commonly referred to as the drill pipe pressure (DPP); and (3) the operating pressure within the bottom of the wellbore 12, commonly referred to as the bottom hole pressure (BHP). In order to facilitate the manual human control 30 of the CSP, the DPP, and the BHP, sensors, 32*a*, 32*b*, and 32*c*, respectively, may be positioned within the well 10 that provide signals representative of the actual values for CSP, DPP, and/or BHP for display on a conventional display panel 34. Typically, the sensors, 32*a* and 32*b*, for sensing the CSP and DPP, respectively, are positioned within the annulus 24 and drill pipe 18, respectively, adjacent to a surface location. The operator 30 may visually observe one or more of the operating pressures, CSP, DPP, and/or BHP, using the display panel 34 and may manually maintain the operating pressures within predetermined acceptable limits by manually adjusting the choke 28. If the CSP, DPP, and/or the BHP are not maintained within acceptable ranges, an underground blowout can occur, thereby potentially damaging the production zones within the subterranean formation 14. The manual operator control 30 of the CSP, DPP, and/or the BHP may be imprecise, unreliable, and unpredictable. As a result, underground blowouts occur, thereby diminishing the commercial value of many oil and gas wells.

Alternatives to manual control may include balanced fluid control and automatic choke control. For example, U.S. Pat. No. 4,355,784 discloses an apparatus and method for controlling back pressure of drilling fluid. A balanced choke device moves in a housing to control the flow and back pressure of the drilling fluid. One end of the choke device is exposed to the pressure of the drilling fluid and its other end is exposed to the pressure of a control fluid.

U.S. Pat. No. 6,253,787 discloses a system and method where the movement of the choke member from a fully closed position to an open position is dampened. An inlet passage and an outlet passage are formed in a housing, and a choke member is movable in the housing to control the flow of fluid from the inlet passage to the outlet passage and to exert a back pressure on the fluid, thus dampening the movement of the choke member. The choke device may operate automatically to maintain a predetermined back pressure on the flowing fluid despite changes in fluid conditions.

U.S. Pat. No. 6,575,244 discloses a system and method to monitor and control the operating pressure within tubular members (drill pipe, casing, etc.). The difference between actual and desired operating pressure is used to control the operation of an automatic choke to controllably bleed pressurized fluidic materials out of the annulus.

Accordingly, there exists a need for a system capable of tighter control of system pressure (CSP, BHP, and/or DPP) in maintaining the user set point pressure (the desired pressure to be maintained in the casing, drillpipe, or borehole).

SUMMARY OF INVENTION

In one aspect, embodiments disclosed herein relate to a fluid control system having a choke assembly, a pressure generating device, and a linear motor. The choke assembly may include a housing having an inlet passage, an axial bore, and a chamber, wherein a portion of the axial bore forms an outlet passage, and a choke member adapted for movement in the housing to control the flow of a fluid from the inlet passage to the outlet passage, wherein the fluid applies a force on a first end of the choke member. The pressure generating device may be fluidly connected to the chamber and may contain a control fluid, wherein the control fluid applies a first force on a second end of the choke member. The linear motor may be configured to apply a second force on the second end of the choke member. The difference between the forces applied to the first and second ends of the choke member may affect the movement of the choke member in the housing.

In other aspects, embodiments disclosed herein relate to a method of controlling one or more operating pressures within a subterranean borehole that includes a choke assembly that has a housing having an inlet passage, an axial bore, and a chamber, wherein a portion of the axial bore forms an outlet passage, a choke member adapted for movement in the housing to control the flow of a fluid from the inlet passage to the outlet passage, and a pressure generating device fluidly connected to the chamber and containing a control fluid. The method may include applying a force on a first end of the choke member with the fluid, applying a first force on a second end of the choke member with the control fluid, and applying a second force on the second end of the choke member with a linear motor, wherein a difference in forces applied to the choke member affects a movement of the choke member in the housing Other aspects and advantages of the invention will be apparent from the following description and the appended claims.

DETAILED DESCRIPTION

In one aspect, embodiments disclosed herein relate to the use of electrical energy to generate the hydraulic force necessary to operate a choke system. In some embodiments, the electrical energy may be directly correlated to hydraulic energy without positional constraints. In other embodiments, a control system may use proportional, integral, and/or derivative (PID) functions to maintain pressure near the user set point.

Figure 1:
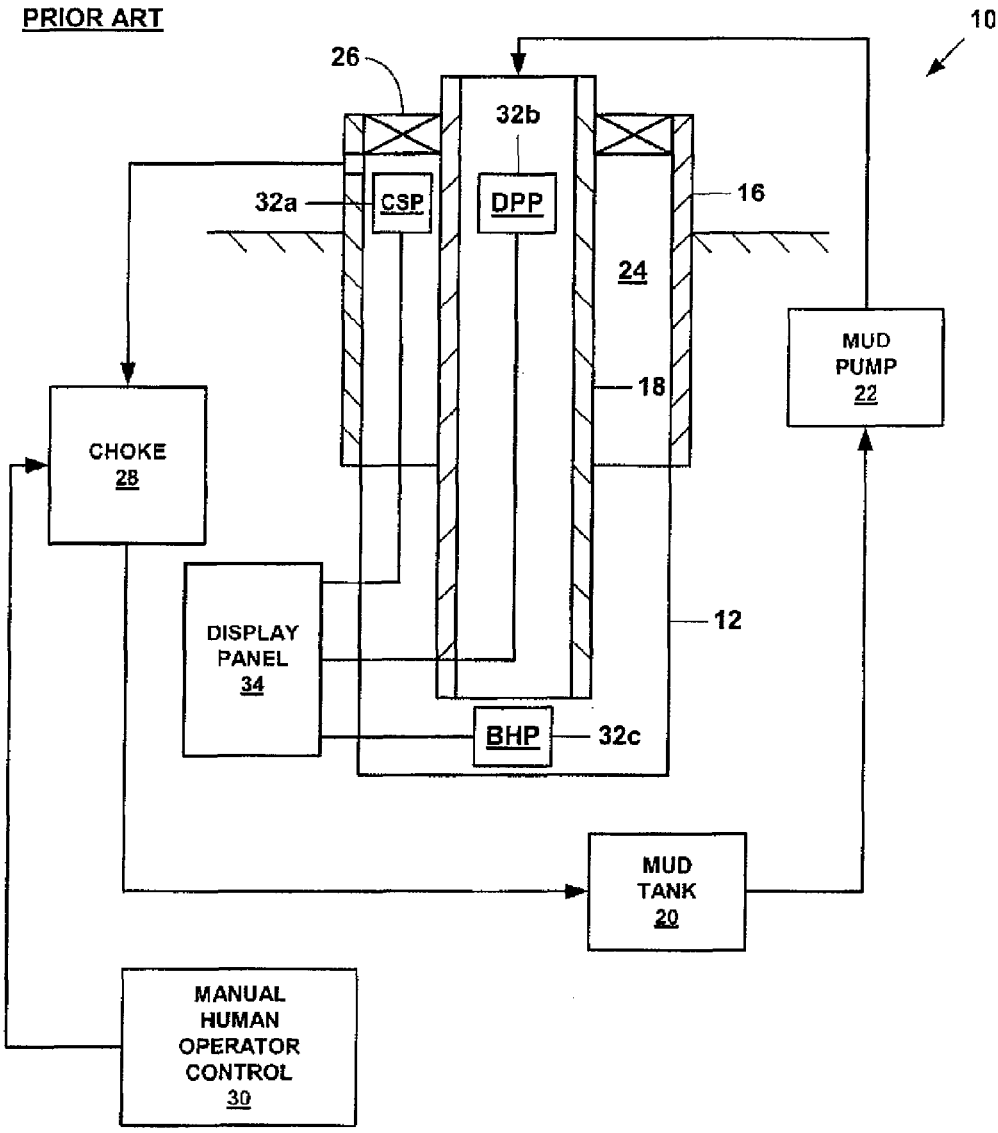
FIG. 1 is a schematic illustration of an embodiment of a conventional oil or gas well.
Figure 2:
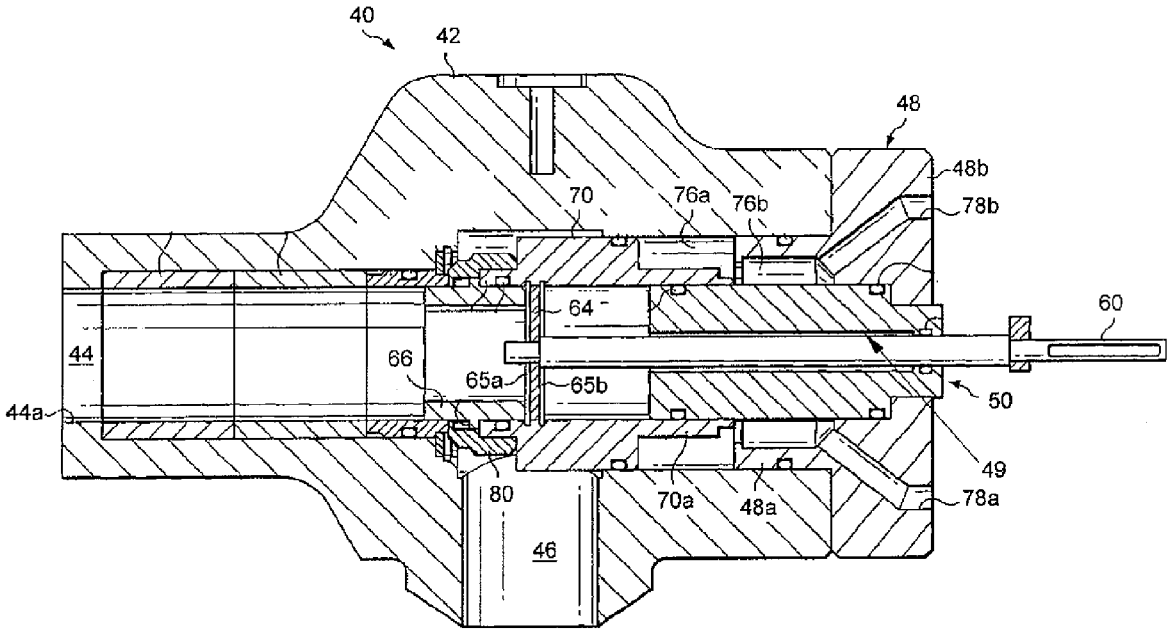
FIG. 2 is a cross sectional view of a choke valve useful in embodiments disclosed herein.

A choke system useful in embodiments disclosed herein is illustrated in FIG. 2. Choke system 40 includes a housing 42 having an axial bore 44 extending through its length and having a discharge end 44*a*. A radially extending inlet passage 46 is also formed in the housing 42 and intersects the bore 44. It is understood that connecting flanges, or the like, (not shown) may be provided at the discharge end 44*a* of the bore 44 and at the inlet end of the passage 46 to connect them to appropriate flow lines. Drilling fluid from a downhole well is introduced into the inlet passage 46, passes through the housing 42 and normally discharges from the discharge end 44*a* of the bore 44 for recirculation.

As shown, a bonnet 48 is secured to the end of the housing 42 opposite the discharge end 44*a* of the bore 44. The bonnet 48 is substantially T-shaped in cross section and has a cylindrical portion 48*a* extending into the bore 44 of the housing. The bonnet 48 also includes a cross portion 48*b* that extends perpendicular to the cylindrical portion 48*a* and is fastened to the corresponding end of the housing 42 by any conventional manner, for example, bonnet 48 may be threadedly or weldably connected to housing 42.

A mandrel 50 is secured in the end portion of the bonnet 48, and a rod 60 is slidably mounted in an axial bore 49 extending through the mandrel 50. A first end portion of the rod 60 extends from a first end of the mandrel 50 and the bonnet 48, and a second end portion of the rod 60 extends from a second end of the mandrel 50 and into the bore 44.

A spacer 64 is mounted on the second end of the rod 60 in any known manner and may be disposed between two snap rings 65*a* and 65*b*. A cylindrical choke member 66 is disposed in the bore 44 with one end abutting the spacer 64. The choke member 66 is shown in its fully closed position in FIG. 2, wherein choke member 66 extends in the intersection of the bore 44 with the inlet passage 46 to control the flow of fluid from inlet passage 46 to bore 44.

A cylindrical shuttle 70 is slidably mounted over the mandrel 50. The shuttle 70 has a reduced-diameter portion 70*a* that defines, with the inner surface of the housing 42, a fluid chamber 76*a*. Another fluid chamber 76*b* is defined between the outer surface of the mandrel 50 and the corresponding inner surface of the bonnet portion 48*a*. The chambers 76*a* and 76*b* communicate and receive a control fluid from a passage 78*a* formed through the bonnet 48. Passage 78*a* may be fluidly connected to a pressure generating device (not shown), such as a hydraulic system as described below, for circulating the control fluid into and from the passage. A passage 78*b* may also be formed through the bonnet portion 48 for bleeding air from the system through a bleed valve, or the like (not shown), before operation. In this context, the control fluid is introduced into the passage 78*a*, and therefore, the chambers 76*a* and 76*b*, at a predetermined set point pressure.

The control fluid enters the chambers 76*a* and 76*b* and applies pressure against the corresponding exposed end portions of the shuttle 70. The shuttle 70 is designed to move so the force caused by the pressure of the control fluid from the chambers 76*a* and 76*b* at the predetermined set point pressure acting on the corresponding exposed end portions of the shuttle is equal to the force caused by the pressure of the drilling fluid in the passage 46 acting on the corresponding exposed end portions of the other end of the shuttle 70 and a retainer 80.

Axial movement of the shuttle 70 over the fixed mandrel 50 causes corresponding axial movement of the choke member 66, and therefore the spacer 64 and the rod 60. Similarly, forces applied to rod 60 may be translated to shuttle 70 and choke member 66; likewise, forces applied to choke member 66 or shuttle 70 may be translated to rod 60.

Other embodiments of choke valves that may be useful in embodiments disclosed herein may include those described in U.S. Pat. Nos. 4,355,784, 6,253,787 and 7,004,448, assigned to the assignee of the present invention and incorporated by reference herein.

The position of the shuttle within the choke system may be controlled in some embodiments by one or more linear motors or electric actuators directly or indirectly coupled to the rod 60. In other embodiments, a linear motor directly or indirectly coupled to the rod 60 may directly provide a force to the shuttle. These and other embodiments of linear motors used with a choke system are described in more detail below.

Electric actuators use electromagnetism to controllably vary the position of a movable component with respect to a stationary component. Linear motors use electromagnetism to controllably vary the position or the force of a movable component with respect to a stationary component. Embodiments described herein may apply equally to linear motors and electric actuators. In some embodiments, the linear motors used in embodiments disclosed herein may include flat linear motors, tubular linear motors, or combinations thereof. Where reference may be made to flat linear motors in some embodiments, tubular linear motors may also be used, and vice versa.

Linear motors may include moving coil, moving magnet, alternating current (AC) switched reluctance design, AC synchronous design, AC induction or traction design, linear stepping design, direct current (DC) brushed design, and DC brushless design, as known in the art. In a moving coil design, for example, the coil moves and the magnet is fixed. In a moving magnet design, for example, the magnet moves and the coil is fixed.

Important specifications to consider include rated continuous thrust force, peak force, maximum speed, maximum acceleration, nominal stator length, slider or carriage travel, slide or carriage width, and slider or carriage length. For example, for use of a linear motor to supply a constant force, the rated continuous thrust force, the maximum rated current that can be supplied to the motor windings without overheating, is an important design variable.

Linear motors allow for relatively fast accelerations and relatively high velocities of the movable component, which may allow for tighter control of the shuttle position or hydraulic pressure set point. In some embodiments, the one or more linear motors may have a velocity between end points of up to 500 in/sec; up to 400 in/sec in other embodiments; up to 300 in/sec in other embodiments; up to 250 in/sec in other embodiments; up to 200 in/sec in other embodiments; and up to 100 in/sec in yet other embodiments. In other embodiments, the velocity between endpoints may be variable and/or controllable. In some embodiments, the linear motor may accelerate a movable component at rates as high as 98 $m/s^2$ (10 G's); up to 8 G's in other embodiments; up to 6 G's in other embodiments; and up to 5 G's in yet other embodiments. Thus, in some embodiments, such as where a linear motor is directly coupled to the rod for example, the linear motor may rapidly open and close the shuttle to maintain pressure in the tubulars around the set point pressure.

Linear motors may advantageously provide a constant and reversible force. For example, for a tubular linear motor having a moving magnet (similar to a piston moving within a cylinder), magnetic-attractive forces may be applied causing the magnet to move with a constant force. Application of a constant force may provide for consistency of operation of the choke, for example, where a linear motor is used to generate a force to operate the shuttle. When the pressure (CSP, DPP, and/or BHP as appropriate) exceeds the force applied by the linear motor, the moving magnet may be moved toward an open position so as to allow the pressure in the tubular(s) to be vented while maintaining a force on the shuttle toward a closed position with the linear motor. Thus, when the pressure decreases, the shuttle may automatically move toward the closed position, maintaining pressure control within the tubulars.

Linear motors and electric actuators also allow for a relatively high degree of precision in controlling the position of the movable component relative to the stationary component. In some embodiments, the positioning may be repeatable to within 10 microns of previous cycles; within 5 microns in other embodiments; and within 1 micron in yet other embodiments. Repeatable positioning may provide for consistency of operation of the choke due to reliable positioning, for example, where a linear motor is used to directly operate the shuttle.

In some embodiments, a hydraulic cylinder may supply a control fluid to a choke valve. The hydraulic cylinder may be used to control the pressure of the control fluid, thus affecting the pressure applied to the choke member by the control fluid. A linear motor may be used to supplement the force applied by the control fluid on the choke member. The combined forces applied by the linear motor and the control fluid may affect a position of the choke member within the choke valve, thus allowing for pressure control of the drilling fluid, for example.

Figure 3:
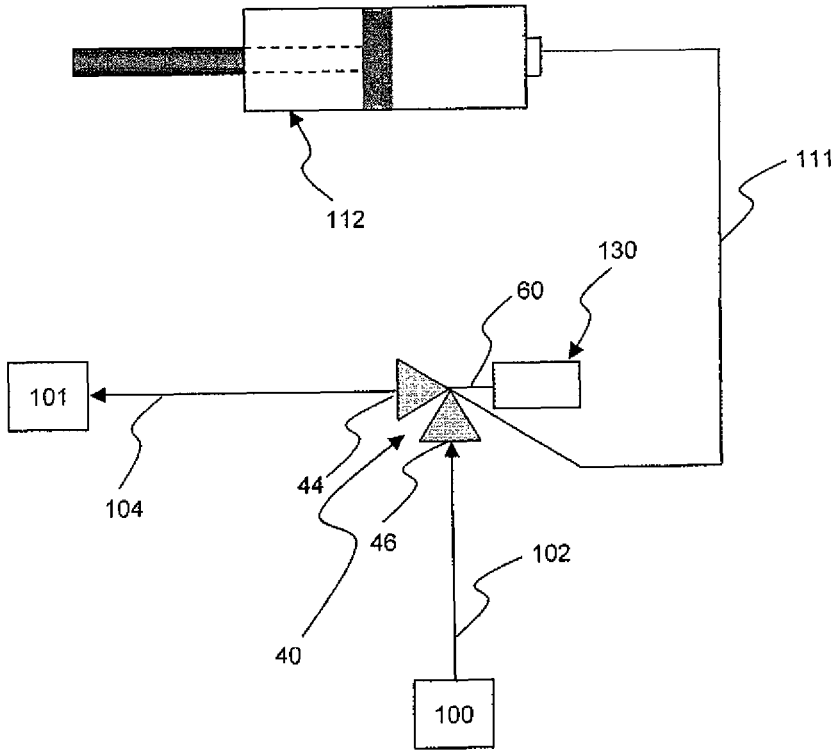
FIG. 3 is a schematic illustration of a pressure-balanced choke system in accordance with embodiments disclosed herein.

Referring now to FIG. 3, a simplified schematic drawing of a choke system is illustrated, where like numerals represent like parts. A choke valve 40 may be used to control flow of a fluid, for example, a drilling fluid flowing from a wellbore 100 to a mud system 101. A fluid connection 102 may connect the wellbore 100 to inlet passage 46 of a choke valve 40. A fluid connection 104 may connect discharge bore 44 to the mud system 101. Fluid connections may include piping, tubing, and other conduits for transporting fluids, for example.

Figure 5:
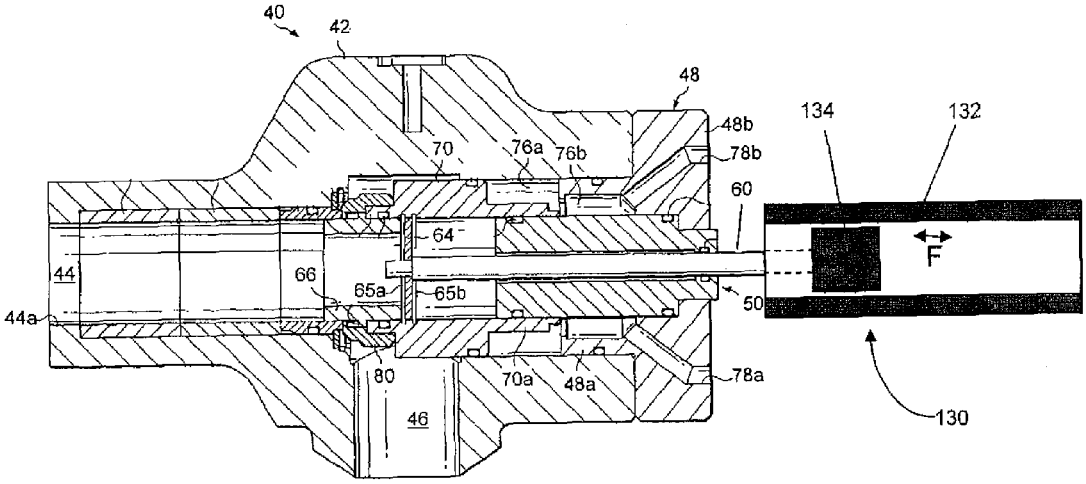
FIG. 5 is a schematic illustration of a choke valve coupled to a tubular linear motor useful in embodiments disclosed herein.
Figure 6:
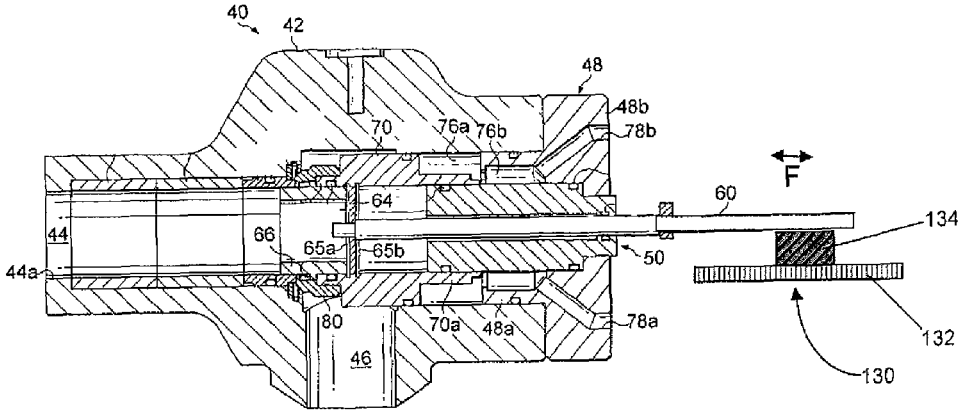
FIG. 6 is a schematic illustration of a choke valve coupled to a flat linear motor useful in embodiments disclosed herein.

Referring now to FIGS. 3, 5, and 6, a conduit 111 may fluidly connect a hydraulic cylinder 112 to passage 78*a* (shown in FIGS. 5 and 6). A control fluid may be contained within hydraulic cylinder 112 and conduit 110. The drilling fluid flowing through fluid connection 102 may exert a pressure upon a first end of choke member 66 as described above. Hydraulic cylinder 112 may exert a pressure on the control fluid, thus causing the control fluid in chambers 76*a*, 76*b* to exert a pressure on a second end of choke member 66, as described above.

In addition to the pressure exerted by the control fluid, a linear motor 130 may directly or indirectly apply a force to the choke member 66. For example, as illustrated in FIG. 5, a tubular linear motor 130, having a stationary component 132 and a movable component 134 coupled to rod 60, may apply a force F to choke member 66. As illustrated in FIG. 6, a flat linear motor 130, having a stationary component 132 and a movable component 134 coupled to rod 60, may apply a force F to choke member 66. The current (amperage) supplied to the linear motor may be used to generate the force F on the choke member 66.

The force F applied by linear motor 130 may be used to achieve the desired pressure set point for the fluid in the tubulars. For example, the difference in forces applied on the choke member 66 may affect the position of the choke member 66, thereby controlling the flow of fluid from inlet 46 to outlet 44. Where the pressure exerted by the drilling fluid on a first end of the choke member 66 in passage 44 exceeds the combined forces exerted by linear motor 130 and the control fluid in chambers 76*a*, 76*b*, choke member 66 may move toward an open position allowing fluid to flow from inlet 46 to outlet 44. When the combined forces from the control fluid and the linear motor exceed the pressure exerted by the fluid in inlet passage 46, choke member 66 may move toward a closed position, restricting fluid flow from inlet 46 to outlet 44.

In some embodiments, linear motor 130 may use amperage control to directly generate the desired force F. In this manner, the motor controller (not shown), controlling a linear motor 130 coupled to the choke member 66, may continuously attempt to close the choke shuttle 70. The controller may vary the current supplied to the linear motor 130, varying the strength of the magnetic attractive force between the stationary component 132 and the movable component 134, generating the desired force F. In some embodiments, the controller may incorporate PID control to not only set the output based on the set point pressure, but may also vary the output to maintain tighter set point control.

In other embodiments, a pressure diaphragm may supply a control fluid to a choke valve. The pressure diaphragm may translate a pressure from a fluid, such as the drilling fluid flowing through the choke valve, to the control fluid. A linear motor may be used to supplement the force applied by the control fluid on the choke member. The combined forces applied by the linear motor and the control fluid may affect a position of the choke member within the choke valve, thus allowing for pressure control of the drilling fluid, for example.

Figure 4:
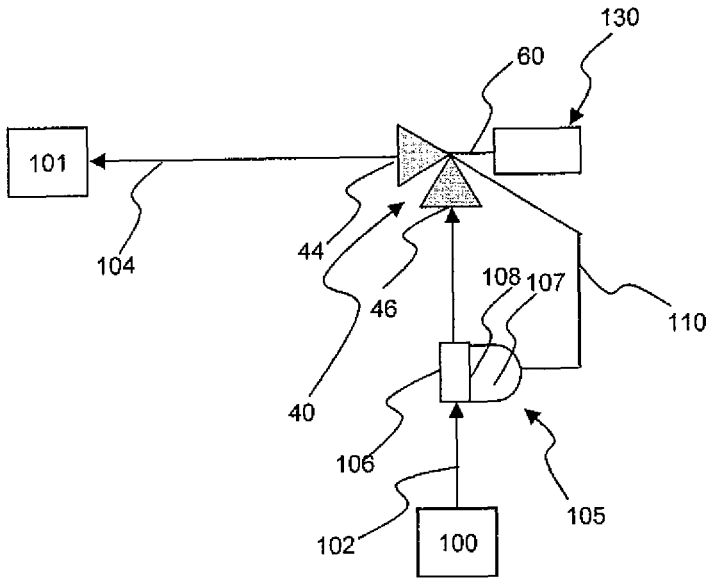
FIG. 4 is a schematic illustration of a pressure-balanced choke system in accordance with embodiments disclosed herein.

Referring now to FIG. 4, a simplified schematic drawing of a choke system is illustrated, where like numerals represent like parts. A choke valve 40 may be used to control flow of a fluid, for example, a drilling fluid flowing from a wellbore 100 to a mud system 101. A fluid connection 102 may connect the wellbore 100 to inlet passage 46 of choke valve 40. A fluid connection 104 may connect discharge bore 44 to the mud system 101. A pressure diaphragm 105, having a first fluid zone 106, a second fluid zone 107, and a flexible diaphragm 108 separating zones 106, 107, may be disposed in fluid connection 102.

Referring now to FIGS. 4-6, a conduit 110 may fluidly connect second fluid zone 107 to passage 78*a* (see FIGS. 5 and 6). A control fluid may be contained within second fluid zone 107 and conduit 110. The drilling fluid flowing through fluid connection 102 may exert a pressure on the flexible diaphragm 108, and may also exert a pressure upon a first end of choke member 66 as described above. Flexible diaphragm 108 may translate the pressure of the drilling fluid in first fluid zone 106 to the control fluid in the second fluid zone 107, thus causing the control fluid in chambers 76*a*, 76*b* to exert a pressure on a second end of the choke member 66, as described above.

In this manner, the drilling fluid may supply a pressure to a control fluid, balancing the pressures within the choke valve system. In some embodiments, the pressure exerted by the control fluid in first fluid zone 106 may be about equal to the pressure exerted by the control fluid on the second end of choke member 66. In other embodiments, the pressure exerted by the control fluid in the first fluid zone 106 may be greater than the pressure exerted by the control fluid on the second end of choke member 66.

In addition to the pressure exerted by the control fluid, a linear motor 130 may directly or indirectly apply a force to the choke member 66. For example, as illustrated in FIG. 5, a tubular linear motor 130, having a stationary component 132 and a movable component 134 coupled to rod 60, may apply a force F to choke member 66. As illustrated in FIG. 6, a flat linear motor 130, having a stationary component 132 and a movable component 134 coupled to rod 60, may apply a force F to choke member 66. The current (amperage) supplied to the linear motor may be used to generate the force F on the choke member 66.

The force F applied by linear motor 130 may be used to achieve the desired pressure set point for the fluid in the tubulars. For example, the difference in forces applied on the choke member 66 may affect the position of the choke member 66, thereby controlling the flow of fluid from inlet 46 to outlet 44. Where the pressure exerted by the drilling fluid on a first end of the choke member 66 in passage 44 exceeds the combined forces exerted by linear motor 130 and the control fluid in chambers 76*a*, 76*b*, choke member 66 may move toward an open position allowing fluid to flow from inlet 46 to outlet 44. When the combined forces from the control fluid and the linear motor exceed the pressure exerted by the fluid in inlet passage 46, choke member 66 may move toward a closed position, restricting fluid flow from inlet 46 to outlet 44.

In some embodiments, linear motor 130 may use amperage control to directly generate the desired force F. In this manner, the motor controller (not shown), controlling a linear motor 130 coupled to the choke member 66, may continuously attempt to close the choke shuttle 70. The controller may vary the current supplied to the linear motor 130, varying the strength of the magnetic attractive force between the stationary component 132 and the movable component 134, generating the desired force F. In some embodiments, the controller may incorporate PID control to not only set the output based on the set point pressure, but may also vary the output to maintain tighter set point control.

One benefit of using a linear motor may be in the automatic response of the choke system. Because the linear motor movable component may be free-floating with respect to the stationary component, and the controller may provide only the force necessary to maintain set point pressure, the position of the movable component may fluctuate to intermittently allow fluid to pass through the choke system, maintaining pressure control. A change in pressure would not need to be sensed and then "released," as in a positional type choke, thus resulting in a quicker response time for controlling system pressure.

Additionally, because a linear motor is not positionally bound, as in a screw type motor, the linear motor does not need to correlate position to pressure. The linear motor position may be held only by electrical energy and may be allowed to freely move along the track in either direction as the system forces dictate. Because the linear motor may be operated in a constant force control mode, it may provide instantaneous pressure response, generating a direct correlation between current and pressure.

In other embodiments, a linear motor or electric actuator 130 may be directly or indirectly coupled to the rod 60 of the choke 40 to control the position of choke member 66 and shuttle 70. A linear motor, similar to an air or hydraulic actuator, may control the position of the choke member 66 and shuttle 70 in response to tubular pressures. Due to the pressure balance attained by the control fluid supplied by a hydraulic cylinder or a pressure diaphragm, linear motor 130 may be smaller than would be required for positional control of the choke member 66 and shuttle 70 without a pressure balance.

Systems using a linear motor to apply force F, in accordance with embodiments disclosed herein, to affect shuttle movement or to position the shuttle may also include a controller to control the magnitude of force F based upon the pressure in the tubulars and the position of the shuttle (open or closed). The hydraulic pressure control system may include logic based upon set point pressure, casing pressure, and choke valve properties to determine when a force F toward an open or closed position would be advantageous, and what force to apply.

For example, when tubular pressure is greater than a set point pressure, a PID controller may decrease a force F toward a closed position or may increase a force F applied toward an open position. As borehole (tubular) pressure returns toward set point, the force may be appropriately changed to allow the shuttle to move toward the closed position. In this manner, control of the forces F applied by the linear motor may allow for a faster system response in opening and closing the shuttle. Thus, the magnitude of the high pressure peaks and low pressure valleys may be decreased, illustrative of smoother, more consistent pressure control. Linear motors may advantageously meet the need for fast acceleration when force F is reversed to control system pressure in this manner.

As described above, flat and tubular linear motors may be used to control shuttle position, and may advantageously provide for the direct correlation of electrical current (magnetic forces) and hydraulic energy. Due to the free-floating nature of linear motors, the hydraulic power generated may control the system pressure without positional restrictions (i.e., motor position does not correlate to force generated).

Advantageously, embodiments disclosed herein may provide for choke systems and methods for controlling pressure within tubulars. Other embodiments disclosed herein may provide for a pressure diaphragm to transfer wellbore pressure to a pressure chamber of a choke valve, balancing the pressures applied to opposing sides of a choke member. The balanced forces across the choke member may allow for use of a linear motor or electric actuator to control pressure within the tubulars at a set point pressure. The balanced forces achieved with some embodiments disclosed herein may allow for use of a smaller linear motor or electric actuator than would be needed for control of pressure through use of a linear motor or electric actuator alone.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A fluid control system, comprising:

a choke assembly comprising:

a housing having an inlet passage, an axial bore, and a chamber, wherein a portion of the axial bore forms an outlet passage; and a choke member adapted for movement in the housing to control a flow of a fluid from the inlet passage to the outlet passage;

wherein the fluid applies a force on a first end of the choke member;

a pressure generating device fluidly connected to the chamber and containing a control fluid, wherein the control fluid applies a first force on a second end of the choke member; and a linear motor configured to apply a second force on the second end of the choke member;

a control system to control the second force applied to the second end of the choke member to, in conjunction with the first force applied to the second end, vary a choke member position intermediate an open position and a closed position, thereby controlling a pressure of the fluid in the inlet passage.

2. The fluid control system of claim 1, further comprising:

a source for supplying the fluid flowing from the inlet passage to the outlet passage;

wherein the pressure generating device fluidly connected to the chamber comprises a pressure diaphragm comprising:

a first fluid zone comprising an inlet fluidly connected to the source for supplying the fluid flowing from the inlet passage to the outlet passage, and an outlet fluidly connected to the inlet passage;

a second fluid zone fluidly connected to the chamber; and a flexible diaphragm separating the first fluid zone and the second fluid zone;

wherein the flexible diaphragm translates a pressure of the fluid in the first fluid zone to the control fluid in the second fluid zone.

3. The fluid control system of claim 1, wherein the source of control fluid comprises a hydraulic cylinder fluidly connected to the chamber.

4. The fluid control system of claim 1, wherein the linear motor is a tubular linear motor.

5. The fluid control system of claim 1, wherein the linear motor is a flat linear motor.

6. The fluid control system of claim 1, wherein the linear motor is directly coupled to the choke member.

7. The fluid control system of claim 1, wherein the position of the choke member is repeatable.

8. The fluid control system of claim 1, wherein the linear motor comprises a stationary component and a movable component, and wherein the movable component has a velocity between 100 in/sec and 500 in/sec.

9. The fluid control system of claim 1, wherein the linear motor is configure to both supplement the force applied by the control fluid and counter a portion of the force applied by the control fluid.

10. A fluid control system, comprising:

a choke assembly comprising:

a housing having an inlet passage, an axial bore, and a chamber, wherein a portion of the axial bore forms an outlet passage; and a choke member adapted for movement in the housing to control the flow of a fluid from the inlet passage to the outlet passage;

wherein the fluid applies a force on a first end of the choke member;

a pressure generating device fluidly connected to the chamber and containing a control fluid, wherein the control fluid applies a first force on a second end of the choke member; and a linear motor configured to apply a second force on the second end of the choke member;

a source for supplying the fluid flowing from the inlet passage to the outlet passage;

wherein a difference between the forces applied to the first and second ends of the choke member affects the movement of the choke member in the housing, wherein the pressure generating device fluidly connected to the chamber comprises a pressure diaphragm comprising:

a first fluid zone comprising an inlet fluidly connected to the source for supplying the fluid flowing from the inlet passage to the outlet passage, and an outlet fluidly connected to the inlet passage;

a second fluid zone fluidly connected to the chamber; and a flexible diaphragm separating the first fluid zone and the second fluid zone;

wherein the flexible diaphragm translates a pressure of the fluid in the first fluid zone to the control fluid in the second fluid zone.

11. The fluid control system of claim 10, wherein the linear motor generates the second force by electromagnetism.

12. The fluid control system of claim 10, wherein the linear motor maintains pressure around a set point pressure by moving a shuttle of the choke member toward an open or a closed position.

13. A method of controlling one or more operating pressures within a subterranean borehole that includes a choke assembly comprising a housing and a chamber, a choke member, and a pressure generating device fluidly connected to the chamber and containing a control fluid, the method comprising:

applying a force on a first end of a choke member with a fluid;

applying a first force on a second end of the choke member with a control fluid;

while applying the first force, applying a second force on the second end of the choke member with a linear motor;

varying the second force applied to the second end of the choke member to manipulate a choke member position intermediate an open position and a closed position and thereby control a pressure of the fluid in the inlet passage.

14. The method of claim 13, wherein the pressure generating device fluidly connected to the chamber comprises a hydraulic cylinder.

15. The method of claim 13, wherein the pressure generating device fluidly connected to the chamber comprises a pressure diaphragm comprising:

a first fluid zone comprising an inlet fluidly connected to a source for supplying the fluid flowing from the inlet passage to the outlet passage, and an outlet fluidly connected to the inlet passage;

a second fluid zone fluidly connected to the chamber; and a flexible diaphragm separating the first fluid zone and the second fluid zone;

wherein the flexible diaphragm translates a pressure of the fluid in the first fluid zone to the control fluid in the second fluid zone.

16. The method of claim 13, wherein the linear motor is a tubular linear motor.

17. The method of claim 13, wherein the linear motor is a flat linear motor.

18. The method of claim 13, wherein the applying a second force comprises supplementing the force applied by the control fluid.

19. The method of claim 13, wherein the applying a second force comprises countering a portion of the force applied by the control fluid.

* * * * *